United States Patent [19]

Tschirky

[11] 4,133,396

[45] Jan. 9, 1979

[54] DRILLING AND CASING LANDING APPARATUS AND METHOD

[75] Inventor: John E. Tschirky, Long Beach, Calif.

[73] Assignee: Smith International, Inc., Newport Beach, Calif.

[21] Appl. No.: 848,468

[22] Filed: Nov. 4, 1977

[51] Int. Cl.[2] ..... E21B 3/12; E21B 9/22

[52] U.S. Cl. ..... 175/57; 175/96; 175/107; 175/171; 175/258

[58] Field of Search ..... 175/95, 96, 258, 171, 175/57, 107, 106

[56] References Cited

U.S. PATENT DOCUMENTS

| | | | |
|---|---|---|---|
| 1,461,713 | 7/1923 | Gilman et al. | 175/96 |
| 2,016,068 | 10/1935 | Bannister | 175/96 |
| 2,588,068 | 3/1952 | Williams et al. | 175/171 |
| 2,595,126 | 4/1952 | Causey | 175/96 |
| 3,356,167 | 12/1967 | Trent | 175/95 |
| 3,519,071 | 7/1976 | Word, Jr. | 175/171 |
| 3,539,023 | 11/1970 | Tedrow | 175/57 |
| 3,621,910 | 11/1971 | Sanford | 175/171 |
| 3,661,218 | 5/1972 | Brown | 175/258 |
| 3,732,143 | 5/1973 | Joosse | 175/171 |
| 3,770,067 | 11/1973 | Ikeda | 175/95 |

*Primary Examiner*—William Pate, III

*Attorney, Agent, or Firm*—Bernard Kriegel; Philip Subkow; Newton H. Lee, Jr.

[57] ABSTRACT

Casing is run into a well bore hole on a running pipe string. Fluid motor and drill apparatus is supported in the casing, with the drill extending below the lower end of the casing to drill the bore hole in advance of the casing. For subsea drilling operations, the casing is suspended from a riser housing which lands on a subsea base, and the running pipe is released from the riser housing to enable retrieval of the motor and drill assembly. Plural motors are employed for drilling large holes.

27 Claims, 6 Drawing Figures

DRILLING AND CASING LANDING APPARATUS AND METHOD

BACKGROUND OF THE INVENTION

In the drilling of wells, such as oil and gas wells, both on land and at sea, it is the practice to set a length of relatively large well bore casing in the upper end section of the well bore, and subsequent drilling operations are performed through such surface casing. In certain offshore drilling operations, such as those conducted from a vessel or barge, the drilling operations are conducted through a base which is set and anchored on the floor of the water.

The bore hole may be quite large and the casing quite large, say, on the order of 54 inches or 60 inches. It is sometimes desirable to run the casing into the borehole closely behind the drill bit to prevent the sidewall of the earth from caving in or sloughing off and possibly sticking the drill pipe, or rendering very difficult, if not impossible, the forcing of casing into the hole. Similar problems may be encountered when large piles are being set in boreholes rather than being driven by a pile driver.

It has been proposed, for example, as disclosed in U.S. Pat. No. 3,123,160, granted Mar. 3, 1964, to interconnect with the casing in a well a retrievable drilling apparatus to produce a hole in advance of the casing as the casing is being lowered. The casing could be rotated to effect the drilling operation or the drilling device could be a fluid driven motor and drill combination.

SUMMARY OF THE INVENTION

The present invention provides a combined casing and drilling structure and method for use in drilling a bore hole and placing the casing in the bore hole.

More particularly, the drilling apparatus is incorporated in a length or string of drill pipe adapted to conduct drilling fluid to the fluid driven motor, or a plurality of such motors, to drive the same for turning a drilling bit. The drill pipe is coupled to the casing and the casing is lowered into the bore hole as the drilling progresses.

In soft or incompetent formation, the hole may be drilled slightly undersize and the casing progressively lowered into the soft formation in contact therewith to prevent cave in or sloughing of the formation, while the return of drilling fluid flows upwardly in the casing. In the case of other drilling operations, where the formation does not cave, slough or wash, or where drilling fluid can contain the formation in place, the bore hole may be underreamed or enlarged beneath the casing, and drilling fluid can return through the annular space between the casing and the wall of the bore hole.

In either case, following the drilling operation, after the casing is in place, the coupling between the drill pipe and the casing can be released and the motor drill apparatus retrieved through the casing.

In the subsea drilling of wells, when a base is set on the floor of the sea and the surface casing run into the bore hole on a marine riser housing, the drll pipe is releasably coupled to the marine riser housing which ultimately lands on the base and suspends the casing until it is cemented in place.

The motor-drill apparatus is centralized in the casing. In some cases, the motor-drill may be a motor and single drill assembly in which the drill projects from the lower end of the casing and is centralized in the casing at vertically spaced locations. Such a concentric motor and casing combination may include plural, in-line motors, where, due to the size of the hole and the formation being drilled, high torque is necessary to drive the drill. The reaction torque of the motor is taken by the drill pipe which can be held against rotation while being lowered on a Kelly as customary in drilling operations of the type here involved.

In addition, there may be a plurality of angularly spaced parallel motors centralized within the casing and each having its bit, the several motors being revolved about a central support, either by rotation of the running in pipe string or by a downhole rotary drive unit, as disclosed and claimed in my companion application for U.S. Patent, Ser. No. 834,467, filed Sept. 19, 1977.

This invention possesses many other advantages and has other purposes which may be made more clearly apparent from a consideration of several forms and methods embodying the invention. These forms and methods are shown and described in the present specification and in the drawings accompanying and constituting a part thereof. They will now be described in detail, for the purpose of illustrating the general principles of the invention; but it is to be understood that such detailed description is not to be taken in a limiting sense.

DESCRIPTION OF THE PREFERRED EMBODIMENTS

Figure 1A:
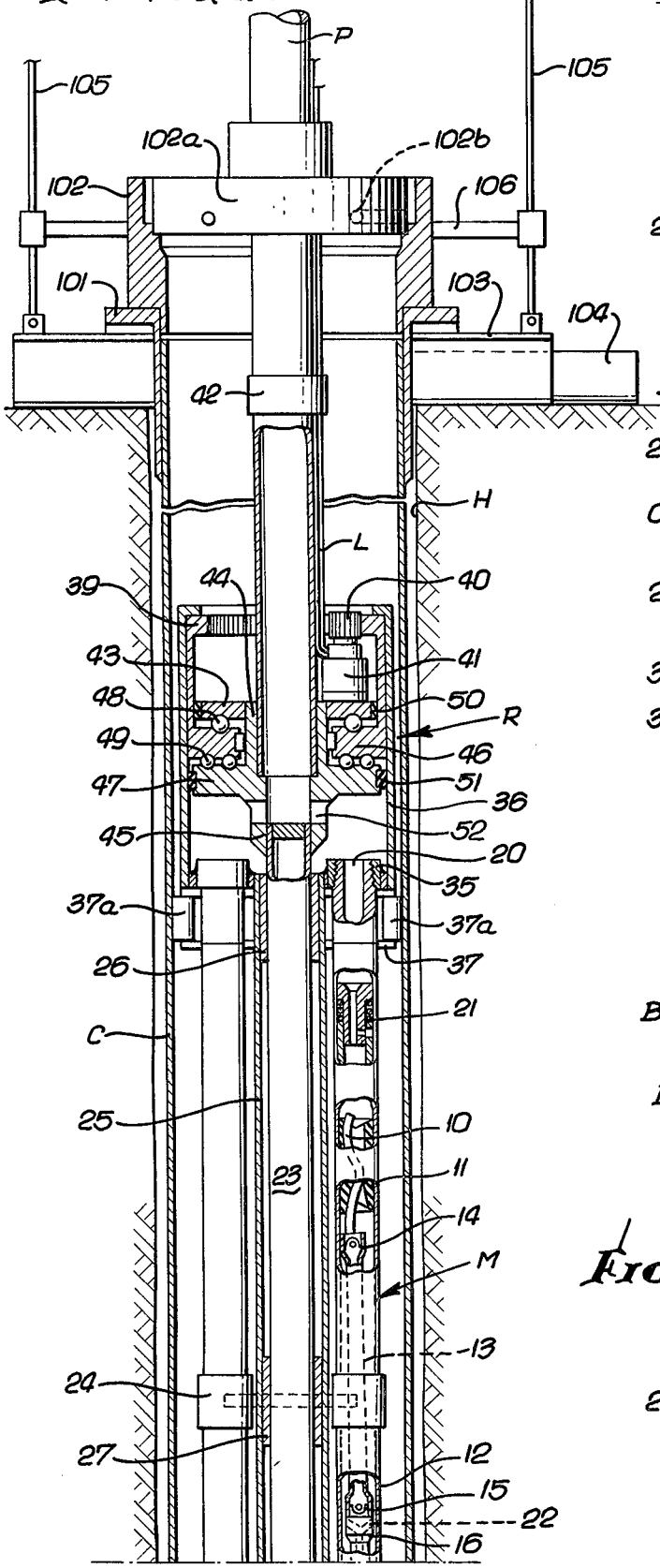
FIGS. 1*a* and 1*b*, together, constitute a view partly in elevation and partly in section showing a drilling and casing running structure, FIG. 1*b* being a downward continuation of FIG. 1*a;*
Figure 1B:
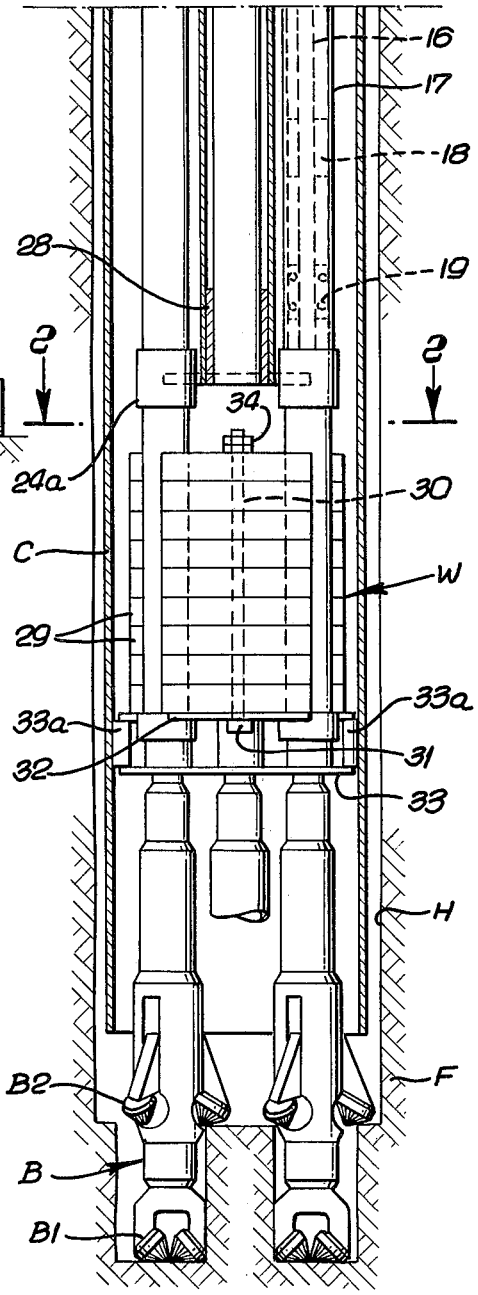

Referring to FIGS. 1*a* and 1*b*, a bore hole H is shown as being drilled through an earth formation F by a plurality of rotatable bits B, including pilot bits B1 and expansible reamers B2 of a well known type, which are at the lower ends of a corresponding plurality of in-hole motor assemblies M supported on a drill pipe or drill casing P which extends upwardly in the bore hole H to a drilling rig or platform (not shown), from which drilling fluid can be circulated downwardly through the drill pipe or casing P, exiting, as will be later described, through the respective bits B and then flowing upwardly through the bore hole H to the top of the hole, the fluid cooling the cutters of the bits and flushing cuttings from the bore hole.

Means are provided whereby the in-hole assembly can be rotated about its axis during the drilling operation. As is well known, the drill pipe or drill casing P, which is utilized in the drilling of bore holes, is typically rotated by a rotary drive table (not shown) during the drilling operation and the weight of the drilling string is applied to the cutters of the bits B to effect their penetration of the earth formation. Such a rotary drive is applied to the drill of the present disclosure, in this embodiment of FIGS. 1*a* and 1*b*, by a subsurface rotary drive unit R powered by hydraulic fluid supplied through supply lines L suitably clamped to the pipe P and extending to the drilling rig for connection with a suitable pump source. The weight is applied to the bits B in accordance with the present embodiment by weight means W incorporated in the assembly above the bits B.

The motors M of the motor drill units, according to the present disclosure, are of the fluid driven helicoidal type, as for example, more particularly disclosed in U.S. Pat. No. 3,989,114 granted Nov. 2, 1976 or U.S. Pat. No. 3,999,901 granted Dec. 28, 1976. Such motors include a rotor 10 revolvable in a stator 11 in response to the flow of motor fluid through the stationary housing of the stator, such fluid discharging from the stator into and elongated housing 12 in which is a connecting rod assembly 13, having an upper universal joint 14 connected to the motor rotor 10 and a lower universal joint 15 connected to a drive shaft 16 which extends downwardly through an elongated bearing housing 17. Within the bearing housing 17 are a suitable radial bearings 18 and thrust bearings 19, centralizing the drive shaft 16 within the bearing housing, and transmitting weight from the weight means W to the drive shaft 16, as it is being rotated by the motor means M. The connecting rod assembly 13 converts the eccentric or orbital motion of the lower end of the motor rotor 10 into concentric rotary motion of the drive shaft 16. The drilling fluid is adapted to be supplied to the motor and drill assembly through an upper inlet 20 at the upper end of the tubular housing assembly, passing downwardly through the usual valve 21, through the motor stator and into the connecting rod housing, from which it enters the hollow drive shaft 16 through upper port means 22 therein, the drilling fluid then passing downwardly through the drive shaft and exiting through the usual bit nozzles, as is well known in the case of drills of the type here involved.

In the illustrated form three of the motor and drill units are revolvably mounted about a central post or shaft 23 and are interconnected by upper and lower connecting collar and bracket assemblies 24 and **24*a* to an outer shaft or support 25, which is revolvable about the center shaft 23 on upper radial bearing means 26, intermediate radial bearing means 27 and lower radial bearing means 28, which are suitably mounted between the inner shaft of post 23 and the outer revolvable shaft 25**.

Figure 2:
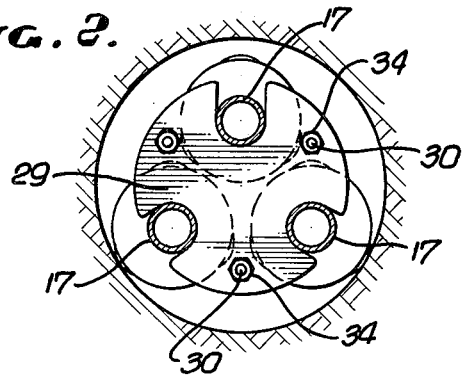
FIG. 2 is a transverse section as taken on the line 2—2 of FIG. 1*b;*

In order to apply weight to the bits B to forcibly cause the cutters thereon to contact the earth formation, a suitable plurality of heavy plates 29 are provided, having, as seen in FIG. 2, circumferentially spaced radially opening slots enabling assembly within the circumferentially spaced drive shaft or bearing housings 17, the weight plates 29 being clamped in place by clamping bolts 30 having lower heads 31 engaged beneath a plate 32 which is mounted between the bearing housings above a stabilizer unit 33, with suitable nuts 34 clamping the weight plates in place upon the plate 32. The stabilizer 33 is of a suitable construction, and as is well known, has either rollers or ribs **33*a*** projecting outwardly therefrom in circumferentially spaced relation for centralizing the unit within the bore hole casing C, later to be described, during the drilling operation.

Adjacent the upper ends of the tubular motor drill assemblies, the housing structure is suitably connected or threaded into, at 35, the lower end of the rotary drive unit R. This drive unit R comprises an external cylindrical housing 36 which carries therebelow a stabilizer 37, which like the stabilizer 33 has outwardly projecting ribs or rollers **37*a* for centralizing the drive unit housing 36** and therefore the upper end of the drill assembly within the casing C.

Within the housing 36 of the rotary drive unit R, adjacent its upper end, is suitably affixed an internal ring gear 39 which is meshed with a drive pinion 40 adapted to be rotated by a high torque, low speed hydraulic motor 41, to which motor fluid is supplied and exhausted by the previously referred to fluid lines L which are suitably clamped to the upwardly extended drill pipe or casing P as by suitable clamps 42. The motor 41 is mounted on an upper plate 43 of a stationary inner sleeve 44, which is suitably affixed to the lower end of the pipestring P as well as to the upper end of the center shaft or post 23 of the drilling assembly, at 45. Suitably secured within the drive unit housing 36 is an outer bearing race member 46 which is disposed between the upper bearing plate 43 and a lower bearing plate 47 projecting outwardly from the bearing sleeve 44. Suitable upper and lower thrust bearings 48 and 49 are disposed between the bearing plates 43 and 46 and between the bearing plates 46 and 47, whereby the housing 36 is supported on the bearings for rotation relative to the stationary drill pipe P and center post 23 of the assembly. Suitable upper and lower seals 50 and 51 are provided between the relatively rotatable components of the drive unit R so as to prevent the entry of drilling fluid into the region of the bearings.

It is apparent that drilling fluid passing downwardly through the drill pipe P can exit from the lower end of the latter through lateral passage means 52 provided in the stationary bearing member 44, the fluid passing into the lower end of the drive unit housing 36 and finding access to the upper passages 20 at the upper end of the respective housings of the motors M.

During use, as the drilling fluid supplied, as just described, through the drill pipe P enters the respective motors to drive the rotors 10 and consequently the respective drive shafts 16, the drill bits B are caused to rotate about their respective axes, the drilling fluid exiting through the bits and flowing upwardly in the bore hole H to the top thereof to flush cuttings therefrom. At the same time the entire assemblage of motor drills is rotated by the rotary drive unit R described above. Since the individual bits B of the respective motor drill units are rotated by the fluid circulating downwardly through the pipestring P, the rotary drive effort necessary to rotate the individual cutting bits is substantially less than the effort necessary to drive a large bore hole bit. As seen in FIG. 2, one of the motor drills is located eccentrically or radially spaced inwardly as compared with the other motor drills, so that the radially outer drill or drills form the gage of the bore hole, and the inner drill will remove the core.

The casing C extends to the top of the bore hole H and is supported by casing hanger means 101 below a conductor pipe housing 102, run on a setting tool **102*a* and landed on a subsea base 103 which is seated on the ocean floor and provides a drilling fluid and cuttings discharge conduit 104. The tool 102*a* is releasable from the housing 102 in a known manner by the provision of suitable locks 102*b*. The underreamer type bits B2 enlarge the bore hole H to enable the progressive downward movement of the casing as the bore hole is being drilled, and cuttings and drilling fluid flow upwardly in the annular space between the casing and the bore hole wall. During the drilling operation, the drilling assembly, supported on the pipe P, is progressively lowered along with the casing C which depends from the conductor pipe housing 102 connected to the running tool 102***a*. Guidelines 105 extend to the vessel or rig above the floor of the sea, and the conductor pipe housing 102 has guide arms 106 slidably engaged with the lines to constrain the upper end of the united casing and drilling apparatus.

Figure 3A:
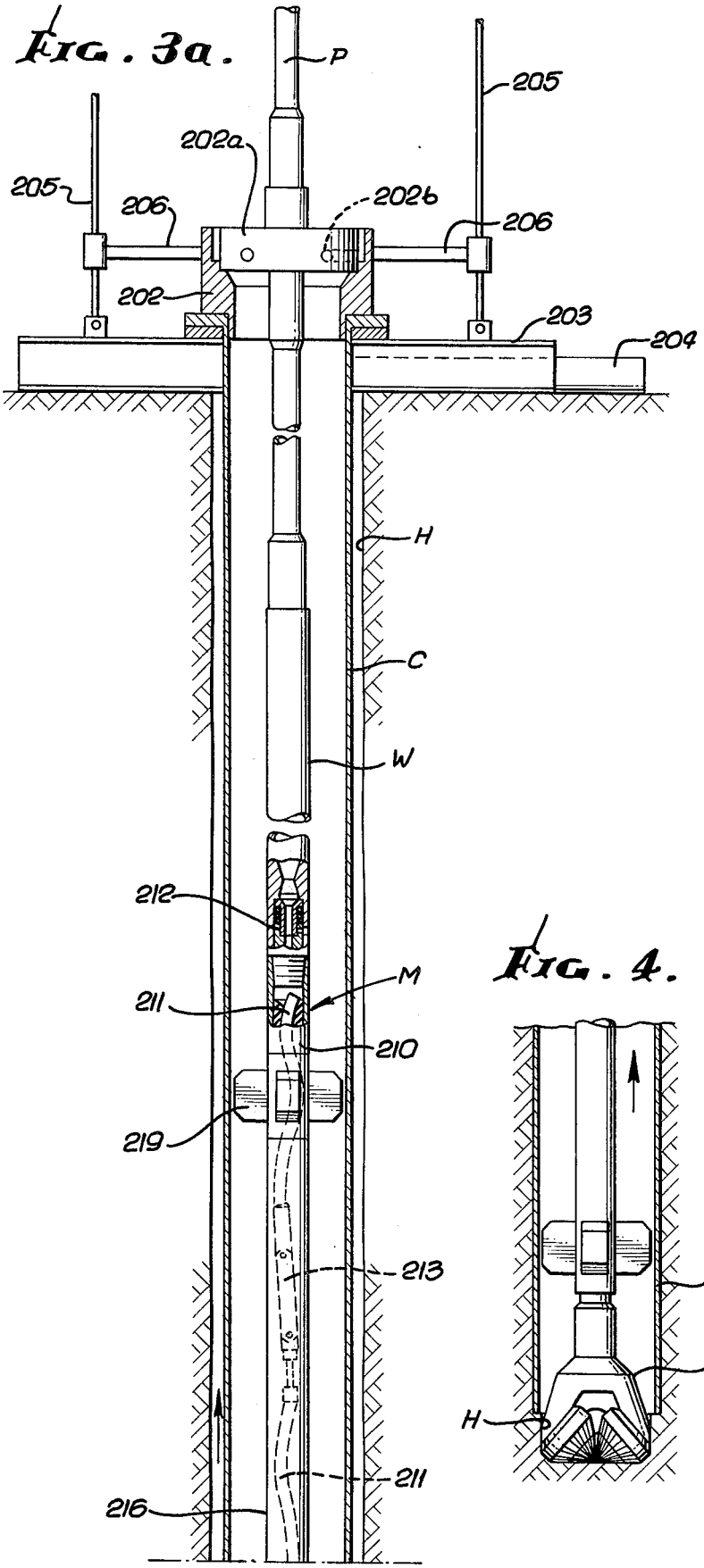
FIGS. 3*a* and 3*b*, together, constitute a view partly in elevation and partly in section showing another drilling and casing running structure, FIG. 3*b* being a downward continuation of FIG. 3*a*.
Figure 3B:
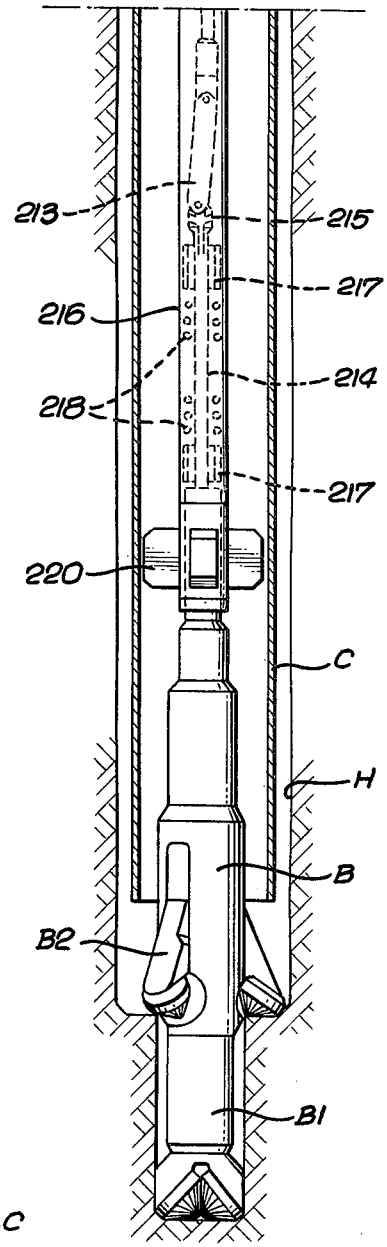

Referring to FIGS. 3*a* and 3*b*, another structure for drilling the bore hole H and simultaneously running the casing C is disclosed. In this structure the running pipe P is also connected to a running tool 202*a* having a J-lock 202*b* releasably connecting the tool to the conductor housing 202, with the casing suspended from the housing and the housing landed on the subsea base 203 which provides a cuttings removal conduit 204. As the structure is lowered through the water on the pipe P it is guided and stabilized by the guidelines 205, which extend upwardly from the base to the vessel or rig, on which the guide arms 206 are slidably disposed.

In this form, the bore hole is drilled by a single bit B having a pilot bit section B1 and the expansible and retractable reamers B2 projecting downwardly and outwardly beneath the lower extremity of the casing C. The bit is rotated by an in-hole motor M to which motor or drilling fluid is supplied through the pipe string P, the fluid discharging through the bit sections B1 and B2 and returning upwardly through the annular space between the hole H and the casing, and then from the cutting removal conduit 204.

The weight means W, in this form, for causing penetration of the bit through the earth formation, is provided by drill collars which are interposed between the drill pipe or drill casing P and the motor.

Since high torque is necessary to turn the single bit B, for drilling large diameter holes, say of a diameter for receiving 30 inches casing, the motor may preferrably be of the compound type more specifically disclosed in the above-identified U.S. Pat. No. 3,999,901. As generally illustrated, such a motor is of the helcoidal, progressing cavity type.

Each motor stage has a stator housing 210 in which a rotor 211 is caused to turn by the flow of drilling fluid downwardly from the drill collars through the usual top valve 212. Upper and lower connecting rod assemblies 213 have universal connections between the upper and lower rotors 211 and between the lower rotor and the upper end of a tubular drive shaft 214 having a fluid inlet 215 at its upper end. Drilling fluid discharging from the lower motor stage enters the drive shaft and exits from the bit.

Weight is transmitted from the motor housing to the drive shaft which is rotatable in the bearing housing 216 having suitable radial bearings 217 and thrust bearings 218 therein. The long tubular assemblage is centralized to resist buckling in the casing by an upper stabilizer 219 and a lower stabilizer 220 having ribs extending radially from the motor-drill assembly towards the casing.

In the use of this form, the casing and motor-drill combination is lowered on the drilling fluid conducting pipe P, with the casing supported on the running tool 202*a*. As the drilling progresses, the drill and casing move downwardly together until the conductor housing lands on the base 203. Then, the tool can be released from the conductor housing and the casing cemented in place in the usual manner.

Figure 4:
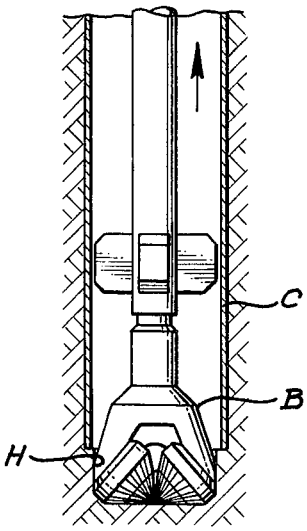
FIG. 4 is a fragmentary view showing the lower end of another drilling and casing running arrangement.

As seen in FIG. 4, the drilling is accomplished by a bit B which drills a borehole H somewhat smaller than the casing, in order that the bit, which has no underreamers, can be recovered upwardly through the casing C, following completion of the drilling operation. The lower end of the casing closely follows the bit and, thus, immediately prevents sloughing or cave-in of the formation. In the use of this form, the drilling fluid is returned upwardly through the casing, and appropriate means (not shown) are provided to accommodate the returned fluid and cuttings at the running tool.

From the foregoing, it will now be apparent that the invention provides for simple installation of the large surface pipe or casing in the drilling of wells or for installing piles in sub-sea installations, by running the casing into the hole as the hole is being formed by the bit or bits driven by the drilling fluid operated motors, which enable the running pipe and casing to be held against rotation.

I claim:

1. The method of simultaneously drilling and casing a bore hole in earth formation comprising: connecting a pipe string to an in-hole fluid motor drill; nonrotatably releasably connecting said pipe string to the upper end of a length of casing, said pipe string suspending said casing with said motor drilling extending through the casing and with a drill bit projecting from the lower end of the casing; simultaneously lowering the pipe string and casing by the connection therebetween with the earth formation, while circulating drilling fluid through the pipe string and the motor drill to drive the latter and rotate the bit relative to the casing to progressively form and case the bore hole; and then disconnecting the pipe string from the casing and removing the pipe string and the motor drill from the cased bore hole.

2. The method of claim 1; including drilling said bore hole larger than the casing with a drill having expansible cutters; and retracting said expansible cutters into the casing during removal of said pipe string and motor drill from the cased bore hole.

3. The method of claim 1; including drilling said bore hole with a plurality of circumferentially spaced motor drills, while rotating said motor drills about said pipe string.

4. The method of claim 1; including drilling said bore hole with a plurality of circumferentially spaced motor drills, while rotating said motor drills about said pipe string, said motor drills having expansible cutters drilling said bore hole larger than the casing; and retracting the cutters into the casing during removal of said pipe string and motor drills from the cased bore hole.

5. The method of claim 1; including drilling said bore hole with a plurality of circumferentially spaced motor drills, while rotating said motor drills about said pipe string and forming the gage of the bore hole with certain of said motor drills and removing the core with another of said motor drills.

6. The method of claim 1; including drilling said bore hole smaller than the casing and forcing said casing into the remaining formation.

7. The method of claim 1; wherein said bore hole is drilled into an underwater formation through a base on the floor, and including supporting said casing on a conductor housing releasably connected to said pipe string; and landing said housing on said base.

8. The method of claim 7; including drilling said bore hole larger than the casing with a drill having expansible cutters; and retracting said expansible cutters into the casing during removal of said pipe string and motor drill from the cased bore hole.

9. The method of claim 7; including drilling said bore hole with a plurality of circumferentially spaced motor drills, while rotating said motor drills about said pipe string.

10. The method of claim 7; including drilling said bore hole with a plurality of circumferentially spaced motor drills, while rotating said motor drills about said pipe string, said motor drills having expansible cutters drilling said bore hole larger than the casing; and retracting the cutters into the casing during removal of said pipe string and motor drills from the cased bore hole.

11. The method of claim 7; including drilling said bore hole with a plurality of circumferentially spaced motor drills, while rotating said motor drills about said pipe string and forming the gage of the bore hole with certain of said motor drills and removing the core with another of said motor drills.

12. The method of claim 7; including drilling said bore hole smaller than the casing and forcing said casing into the remaining formation.

13. The method of claim 7; including guiding said conductor housing on guide lines extending from said base upwardly through the water while drilling said bore hole and lowering said pipe string and casing.

14. The method of claim 7; including guiding said conductor housing on guide lines extending from said base upwardly through the water while drilling said bore hole and lowering said pipe string and casing; said bore hole being formed larger than said casing and said drilling fluid being returned upwardly between said casing and said bore hole and discharging from said base.

15. The method of claim 7; including guiding said conductor housing on guide lines extending from said base upwardly through the water while drilling said bore hole and lowering said pipe string and casing; said bore hole being formed smaller than said casing, and said drilling fluid being returned upwardly between said casing and said motor drill.

16. Apparatus for simultaneously drilling and running casing into a bore hole comprising: a length of bore hole casing; fluid driven motor drill means disposed in said casing; connector means fixedly and releasably connecting said motor drill means to one end of said casing including a tubular housing having means connectable to a drilling fluid conducting pipe string, said motor drill means extending to the other end of said casing and having a rotary drive shaft; and bit means projecting from said other end of said casing and rotatable by said drive shaft to form a bore hole in advance of said casing.

17. Apparatus as defined in claim 16; said connector means comprising a running tool and a marine conductor housing supporting said casing.

18. Apparatus as defined in claim 16; said motor drill means comprising a fluid motor assembly having a central support; a plurality of fluid driven motors disposed in circumferentially spaced relation about said support; means for mounting said motors on said support for rotation thereabout; means for connecting said support to a fluid conduit and directing fluid from said conduit to the respective motors; said motors each having a housing structure for conducting motor fluid therethrough; and a rotary drive shaft having passage means for discharging motor fluid from said motors; said drive shafts each having bit means thereon.

19. Apparatus as defined in claim 18; including variable weight means supported by said motors.

20. Apparatus as defined in claim 18; including rotary drive means between said support and said motors.

21. Apparatus as defined in claim 20; including stabilizer means for centering said motors in said casing.

22. Apparatus as defined in claim 20; said rotary drive means including gear means connected with said motors and a fluid driven motor for said gear means.

23. Apparatus as defined in claim 16; said bit means including expansible cutters for forming a bore hole larger than the casing.

24. Apparatus as defined in claim 16, said bit means having cutters for forming a bore hole smaller than the casing.

25. Apparatus as defined in claim 16; said connector means comprising a running tool and a marine conductor housing supporting said casing; said conductor housing having guide arms projecting outwardly therefrom and having guide means for engaging guidelines extending upwardly from the top of the bore hole.

26. Apparatus for simultaneously drilling and running casing into a bore hole comprising: a casing extensible into the bore hole from a surface location at the entrance of said bore hole; a stationary guide at the entrance of the bore hole; said casing being associated with said guide for nonrotatable longitudinal advance; at least one fluid operated motor disposed in said casing; a drilling fluid conduit connected to said motor and extending from the trailing end of said casing; a drill extending from the advancing end of said casing and driven by said motor; said conduit being non-rotatably releasably connected to said casing at a location longitudinally spaced from said drill, whereby the combined weight of said casing, said motor and said conduit are applicable to said drill.

27. Apparatus as defined in claim 26; including a plurality of said fluid operated motors disposed in angularly spaced relation in said casing.

* * * * *